US005411831A

United States Patent [19]

Sacripante et al.

[11] Patent Number: 5,411,831

[45] Date of Patent: May 2, 1995

[54] TONER WITH CROSSLINKED POLYIMIDES OBTAINED FROM THE REACTION OF AN UNSATURATED POLYIMIDE AND A PEROXIDE

[75] Inventors: Guerino G. Sacripante, Oakville; Stephan V. Drappel, Toronto, both of Canada

[73] Assignee: Xerox Corporation, Stamford, Conn.

[21] Appl. No.: 144,075

[22] Filed: Oct. 28, 1993

[51] Int. Cl.[6] ..... G03G 9/087

[52] U.S. Cl. ..... 430/107; 430/109

[58] Field of Search ..... 430/106, 106.6, 109, 430/110, 111, 107

[56] References Cited

U.S. PATENT DOCUMENTS

| | | | |
|---|---|---|---|
| 4,513,074 | 4/1985 | Nash et al. | 430/106.6 |
| 4,520,090 | 5/1985 | Yamazaki et al. | 430/106.6 |
| 4,543,313 | 9/1985 | Mahabadi et al. | 430/109 |
| 4,560,635 | 12/1985 | Hoffend et al. | 430/106.6 |
| 5,238,768 | 8/1993 | Ong | 430/110 |

OTHER PUBLICATIONS

Encyclopedia of Polymer Science and Engineering, vol. 12, 2nd Edition, published by Wiley, (1985), pp. 364 to 383.

Advances in Polyimides Science in Technology, edited by Cladius Fegere et al., Published by Technomic Publishing (1993).

*Primary Examiner*—John Goodrow

*Attorney, Agent, or Firm*—E. O. Palazzo

[57] ABSTRACT

A toner composition comprised of a pigment and a crosslinked polyimide; and wherein the crosslinked polyimide can be obtained from the reaction of a peroxide with an unsaturated polyimide of the formula

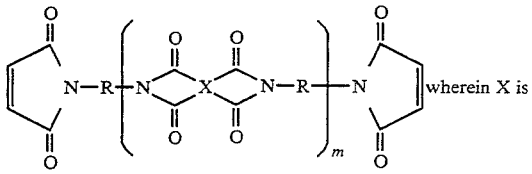

wherein X is

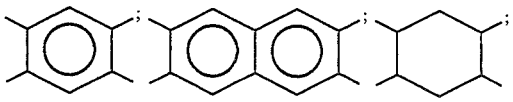

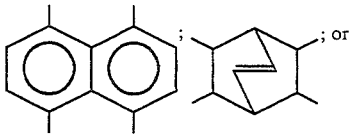

; or

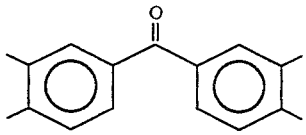

R is alkyl or oxyalkylene; and m represents the number of monomer segments present, and is a number of from about 10 to about about 1,000.

23 Claims, No Drawings

TONER WITH CROSSLINKED POLYIMIDES OBTAINED FROM THE REACTION OF AN UNSATURATED POLYIMIDE AND A PEROXIDE

BACKGROUND OF THE INVENTION

This invention is generally directed to toner and developer compositions, and more specifically, the present invention is directed to developer and toner compositions containing novel crosslinked polyimide resins, and reactive extrusion process for the preparation thereof. In embodiments, there are provided in accordance with the present invention, toner compositions, especially low melting and broad fusing latitude toner compositions, comprised of certain crosslinked polyimide resin and pigment particles, comprised of, for example, carbon black, magnetites, or mixtures thereof, cyan, magenta, yellow, blue, green, red, or brown components, or mixtures thereof thereby providing for the development and generation of black and/or colored images. In embodiments, there are provided in accordance with the present invention crosslinked polyimides obtained from unsaturated polyimide resins of the following formula

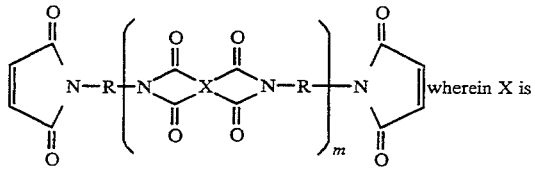

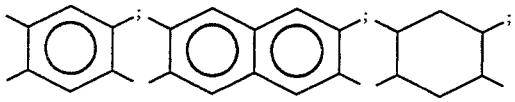

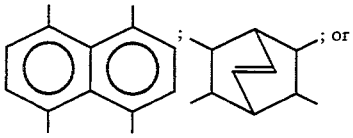

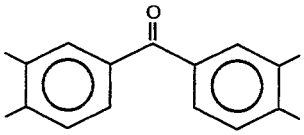

R represents an aliphatic or oxyaliphatic, especially an alkyl group with 1 to about 25 carbons like methyl, ethyl, butyl, propyl, pentyl, hexyl, octyl, nonyl, stearyl, and the like; and m represents the number of monomer segments, and is, for example, a number of from about 10 to about 1,000. Oxyaliphatic includes those components with from 1 to about 25 carbon atoms, such as methylene oxide, ethylene oxide, propylene oxide, the tripropylene oxide, dipropylene oxide, pentipropylene oxide, tetrapropylene oxide, mixtures thereof, and the like. These aforementioned unsaturated polyimides are then reacted, for example, with peroxides, such as benzoyl peroxide and the like, to provide crosslinked polyimides. Processes for the preparation of the toners of this invention include reactive extrusion process wherein the aforementioned unsaturated polyimide resin is admixed with peroxides such as benzoyl peroxide of about 0.1 percent to about 3 percent by weight of polyimide, and then extruded, for instance, utilizing a Davo Twin extruder operated at a barrel temperature of from about 140° C. to about 180° C., thereby causing the linear unsaturated polyimide to result in crosslinked polyimides. The toner compositions of the present invention in embodiments possess a number of advantages including low melting characteristics, excellent blocking characteristics of above 120° F., possess excellent nonvinyl-offset properties, and low relative humidity sensitivity such as from about 1.2 to about 3.0. The unsaturated polyimides of the present invention can in embodiments be generated by the reaction of at least one alkylene diamine, such as branched JEFFAMINES TM available from Texaco Chemicals as JEFFAMINE D-230 TM, D-400 TM, D-700 TM, EDR-148 TM, EDR-192 TM and believed to be of the following formula

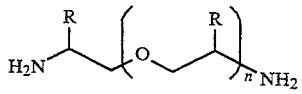

wherein

| | |
|---|---|
| EDR-148 | n = 2; R = H |
| EDR-192 | n = 3; R = H |
| D-230 | n = 2,3; R = $CH_3$ |
| D-400 | n = 5,6; R = $CH_3$ |

The aforementioned unsaturated polyimides exhibit in embodiments a number average molecular weight of from about 3,000 grams per mole to about 100,000, and preferably about 30,000 grams per mole as measured by a vapor phase osmometer, have a glass transition temperature of from about 45° C. to about 65° C., and more preferably of from about 50° C. to about 62° C. as measured by the Differential Scanning Calorimeter.

Examples of advantages of the toner composition of the present invention include low fusing temperatures, such as from about 115° C. to about 145° C., and thus lower fusing energies are required for fixing enabling less power consumption during fusing, and permitting extended lifetimes for the fuser system selected. Furthermore, the toner compositions of the present invention possess in embodiments a broad fusing latitude such as from about 30° C. to about 100° C. with minimal or avoidance of release oil, which inhibits the toner from offsetting onto the fuser rollers usually associated with ghosting or background images on subsequent copies. Additionally, the fused image obtained from the toner compositions of the present invention in embodiments does not substantially offset to vinyl covers, such as those utilized for notebook binders, and possess a low humidity sensitivity ratio of from about 1 to about 2.3 as calculated by the ratio of the triboelectric charge in microcoulombs per gram of the developer after placed in a chamber at 20 percent humidity for 48 hours, to the triboelectric charge in microcoulombs per gram of the developer after placed in a chamber at 80 percent humidity for 48 hours.

For toner resins, it is generally desirable for many uses that the glass transition temperature of the resin be from about 50° C. to about 65° C., and preferably not less than about 55° C., so that the toner particles do not aggregate, coalesce or block during manufacturing, transport storage, or until the toner is required for fixing. Additionally, low fusing toner characteristics are preferred, hence the resin should melt or flow as low in temperature as possible above the glass transition temperature such as from about 1° C. to about 30° C. flow temperature. Moreover, low relative humidity sensitivity of toners is important to the extent that the triboelectric charge is stable to, for example, changes in environmental humidity conditions. Imaging apparatuses, such as xerographic copiers and printers equipped with two component developers, that is a toner as one component mixed with the carrier as the other component can exhibit, for example, a positive or negative triboelectric charge with a magnitude of from about 7 microcoulombs per gram to about 35 microcoulombs per gram as determined by the known Faraday Cage methods. This triboelectric charge of the developer permits the toner particles to be transferred to the latent image of the photoreceptor of opposite charge, thereby forming a toned image on the photoreceptor which is subsequently transferred to a paper or a transparency substrate, and thereafter subjected to fusing or fixing. In many of these development systems, it is important for the triboelectric charge to remain stable under differing environmental humidity conditions such that the triboelectric charge does not change by more than from about 5 to about 10 microcoulombs per gram. A change of more than from about 5 microcoulombs per gram to about 10 microcoulombs per gram in triboelectric charge of the toner developer can, for example, cause nonuniform toned image or cause no toning of the photoreceptor, and thus result in unbalanced image density or gray scale in images, or no images at all. In many climates, humidity ranges may differ of from less than about 20 percent in dry regions to more than about 80 percent in humid regions, and some geographical regions may exhibit fluctuations of up to from about 50 to about 80 percent humidity level within the same day. In these climates, it is desirable that the developmental triboelectric charge does not substantially change by more than from about 5 microcoulombs per gram to about 10 microcoulombs per gram. Since the resins selected for toner can represent, for example, from about 80 percent to about 98 percent by weight of toner, the resin sensitivity to moisture or humidity conditions should be minimized so as to not adversely affect the triboelectric charges. Many polymeric resins utilized as toner compositions, such as for example styrene-acrylates, styrene-methacrylate, styrene-butadiene or polyesters, contain from about 0.1 to about 2 percent by weight of moisture, and in some instances, the moisture contents of the polyester may change from about 0.1 to about 4 percent by weight at humidity levels ranging from about 5 to about 100 percent or, more specifically, from about 20 percent to about 80 percent humidity. These changes in moisture content of the resin may have a dramatic effect in changing the triboelectric charge of the toner developer such as up to about 50 microcoulombs per gram.

Relative humidity sensitivity of toner is customarily measured by first fabricating a toner comprised of a pigment, optionally charge control agent and a resin, and admixing the toner, from about 3 percent by weight to about 7 percent by weight with a carrier, hence generating a toner developer composition. This toner developer composition is then subjected to various humidity levels in a sealed chamber for a finite period of time, such as about 48 hours. The triboelectric charge is then measured for the developer composition at differing humidity levels and evaluated by several methods, such as graphing the triboelectric charge as a function of humidity level and observing the regions in which dramatic changes occur. Another measuring method involves dividing the aforementioned graphical interpolation of tribo vs humidity level in three regions, wherein region 1 is from about 0 to about 30 percent humidity, region 2 is from about above 30 to about 65 percent humidity and region 3 is higher than about 65 percent humidity to about 100 percent. These measurements may be considered cumbersome and time consuming, thus a more practical method in some situations is by measuring the triboelectric charge after subjecting the toner developer composition at two humidity levels such as 20 percent humidity and 80 percent humidity, and then calculating the relative sensitivity by selecting the triboelectric charge ratio of the 20 to 80 percent humidity as follows Equation 1:

$$\text{Relative Humidity Sensitivity} = \frac{\text{Tribo Charge at 20\% RH}}{\text{Tribo Charge at 20\% RH}}$$

wherein RH is the relative humidity.

Thus, if the relative sensitivity is about 1.0, the toner composition is nonhumidity sensitive, whereas if the relative sensitivity is greater than from about 3, or greater than about 5, the toner composition is considered to be very humidity sensitive and may not be as useful in xerographic copiers or printers. It is believed that a number of polymeric materials exhibit relative sensitivity greater than 1.0, and in general, styrene butadiene, or styrene acrylate possess a relative sensitivity of greater than 1.0 and less than about 2.5, whereas polyesters possess a relative sensitivity of greater than 1.8 and less than about 5. Hence, an advantage of the styrene-acrylate or styrene-butadiene class of resins over polyesters is their lower relative sensitivity. Polyesters, however, are known to display advantages over styrene based resins such as in low fixing temperatures of from about 120° C. to about 140° C., high gloss such as from about 50 gloss units to about 80 gloss units, and nonvinyl offset properties. Therefore, there is a need for toner compositions comprised of a resin which possess all of the aforementioned advantages such as low fixing of from about 120° C. to about 140° C., high gloss such as from about 50 gloss units to about 80 gloss units, nonvinyl offset properties and in addition low relative sensitivity such as from about 1.0 to about 2.0. These and other advantages are attained by the toner compositions of this invention comprised of a pigment, optionally a charge control agent and a crosslinked polyimide resin, which toner exhibits in embodiments low fixing of from about 120° to about 140° C., low gloss such as from about 1 gloss units to about 30 gloss units, nonvinyl offset properties and low relative sensitivity such as from about 1.0 to about 2.3. Specifically, in embodiments, the present invention is directed to a toner composition comprised of pigment, charge control agent and certain polyimide resins of the formula illustrated herein, which toners possess low fixing of from about 115° C. to about 145° C., low-gloss such as from about 1 gloss unit to about 30 gloss units as measured by the Gardner Gloss metering unit, nonvinyl offset properties and in addition low relative humidity sensitivity such as from about 1.0 to about 2.0 calculated as illustrated herein and, more specifically, by Equation 1. These and other advantageous are attained by the toners of the invention comprised of a pigment, optionally a charge control agent and, moreover, a crosslinked polyimide resin derived from reacting unsaturated polyimides with a peroxide, such as benzoyl peroxide, and which toner exhibits low fixing of from about 120° C. to about 140° C., low gloss such as from about 1 gloss unit to about 30 gloss units, nonvinyl offset properties and low relative sensitivity such as from about 1.0 to about 2.3.

A number of toner resins are known, such as styrene acrylates, styrene methacrylates, polyesters, polyamides, and generally certain polyimides.

U.S. Pat. No. 5,348,830, illustrates a toner composition comprised of a pigment, and a thermotropic liquid crystalline polyimide of the formula

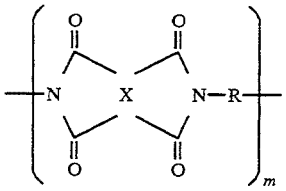

wherein m represents the number of monomer segments present; X is a symmetrical moiety independently selected from the group consisting of phenyl, naphthyl, cyclohexyl, or bicycloaliphatic; and R is independently selected from the group consisting of alkyl, oxyalkylene and polyoxyalkylene.

U.S. Ser. No. 144,956, filed concurrently herewith, illustrates a toner composition comprised of pigment, and polyimide of the formula

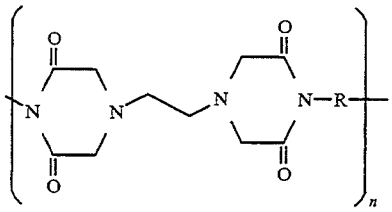

wherein n represent the number of monomer segments, and is a number of from about 10 to about 1,000; and R is alkyl, oxyalkyl, or polyoxyalkyl.

U.S. Pat. No. 5,348,831 illustrates a toner composition comprised of pigment, and a polyester imide resin of the formula

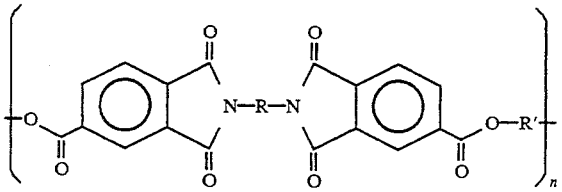

wherein n represent the number of segments present and is a number of from about 10 to about 10,000; R′ is alkyl or alkylene; and R is independently selected from the group consisting of an oxyalkylene and polyoxyalkylene.

U.S. Ser. No. 144,918, filed concurrently herewith, illustrates a toner composition comprised of pigment, and polyimide of the formula

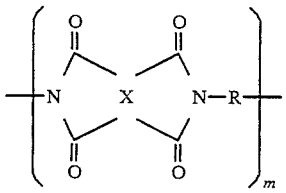

wherein m, represent the number of monomer segments present; X is

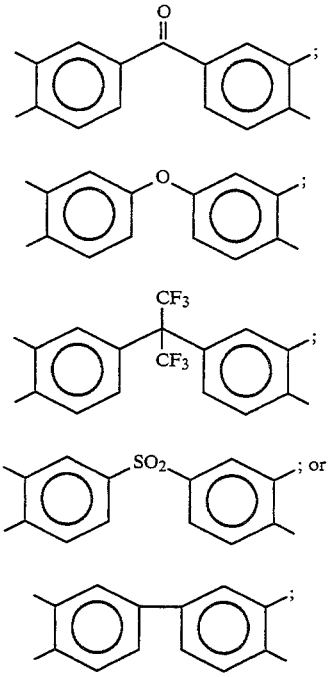

thus X can be benzophenone, oxydiphthalic, hexafluoropropane diphenyl, diphenyl sulfone, or biphenyl; and X is attached to four imide carbonyl moieties; and R is independently selected from the group consisting of alkyl, oxyalkylene and polyoxyalkylene.

There are also disclosed in Advances in Polyimides Science in Technology, edited by Cladius Fegere et al., and published by Technomic Publishing (1993), unsaturated polyimides and crosslinked polyimides. However, these unsaturated and crosslinked polyimide resins are aromatic and useful as high performance materials, and there is no teaching therein relating to toners.

SUMMARY OF THE INVENTION

It is an object of the present invention to provide toner and developer compositions with many of the advantages illustrated herein.

In another object of the present invention there are provided toner compositions with crosslinked polyimides, and which toners are useful for the development of electrostatic latent images including color images.

In yet another object of the present invention there are provided processes for the preparation of certain polyimides by melt condensation methods.

In another object of the present invention there are provided toners with low melt fusing temperatures of from about 130° C. to about 145° C., and a broad fusing latitude of from about 30° C. to about 60° C.

Moreover, in another object of the present invention there are provided toner compositions comprised of crosslinked polyimides with a glass transition temperature of from about 50° C. to about 65° C.

In yet another object of the present invention that are provided unsaturated polyimides with a number average molecular weight of from about 3,000 grams per mole to about 100,000 grams per mole as measured by vapor pressure osmometry.

In yet in another object of the present invention there are provided developer compositions comprised of crosslinked polyimides with a number average molecular weight of from about 5,000 grams per mole to about 500,000 and preferably about 300,000 gram per mole as measured by vapor pressure osmometry.

Moreover, it is an object of the present invention to provide a toner which displays low gloss such as from about 1 to about 30 gloss units as measured by the Gardner Gloss metering unit.

Moreover, it is an object of the present invention to provide a toner which displays low relative sensitivity such as from about 1.0 to about 2.3 as measured by the triboelectric charge ratio at a 20 percent humidity level to a 80 percent humidity level.

Another object of the present invention resides in the formation of toners which will enable the development of images in electrophotographic imaging apparatuses, which images have substantially no background deposits thereon, are substantially smudge proof or smudge resistant, and therefore are of excellent resolution; and, further, such toner compositions can be selected for high speed electrophotographic apparatuses, that is those exceeding 70 copies per minute.

Also, in another object of the present invention there are provided developer compositions comprised of toner and carrier particles.

Additionally, in another object of the present invention there are provided processes for the preparation of polyimides by the reaction of a dianhyride, an unsaturated monoanhydride, and an alkylene oxide diamine, such as a JEFFAMINE TM, followed by crosslinking by, for example, reactive extrusion as illustrated in U.S. Ser. No. 814,641 (D/91117), and U.S. Pat. No. 5,227,460 (D/91117Q), the disclosures of which are totally incorporated herein by reference.

Another object of the present invention resides in the provision of crosslinked polyimides prepared by the reactive extrusion of unsaturated polyimides of the formula as illustrated herein, and subsequently optionally preparing toner compositions by the melt mixing of the obtained crosslinked polyimides with toner components, such as pigments, charge additives, and the like. In embodiments, the toner can be prepared by reactive extrusion subsequent to preparation of the crosslinked polyimide in the same extrusion device.

These and other objects of the present invention can be accomplished in embodiments thereof by providing toner compositions comprised of crosslinked polyimides and in embodiments unsaturated polyimides of the formula illustrated herein, and pigment particles.

The unsaturated polyimide resins of the present invention can be prepared as illustrated herein, that is for example by melt condensation methods. More specifically, there is charged into a reactor, equipped with a bottom drain valve, double turbine agitator and distillation receiver with a cold water condenser from about 0.75 to about 0.95 mole of monomer, such as pyromellitic dianhydride or benzene tetracarboxylic acid, 0.95 to about 1.05 mole of flexible diamine, such as a diamino terminated polyoxypropylene available as JEFFAMINE 230 TM from Texaco Chemicals, and from about 0.05 to about 0.25 mole of unsaturated monomer, such as maleic acid, maleic anhydride or fumaric acid. The reactor is then heated to about 150° C. to about 170° C. with stirring for a duration of from about 3 hours whereby 0.5 to about 0.9 mole of water byproduct is collected in the distillation receiver. The mixture is then heated at from about 180° C. to about 210° C., after which the pressure is slowly reduced from atmospheric pressure to about 300 Torr, over a period of from about 1 hour to about 5 hours with collection of approximately 0.1 to about 0.3 mole of water in the distillation receiver, and wherein the total amount of water collected from the beginning of the reaction is from about 0.95 to about 1.0 mole equivalent. The reactor is then purged with nitrogen to atmospheric pressure, and the resulting unsaturated polyimide is collected through the bottom drain valve. The glass transition temperature of the resin can then be measured to be of from about 45° C. to about 65° C. (onset) utilizing the 910 Differential Scanning Calorimeter available from DuPont operating at a heating rate of 10° C. per minute. The number average molecular weight can be measured to be from about 1,500 grams per mole to about 100,000 grams per mole by vapor phase calorimetry.

The unsaturated polyimides are then crosslinked by, for example, adding to an extruder the polyimide and a crosslink component, such as benzoyl peroxide, lauryl peroxide, cumene, di-tertiary butyl peroxide, and the like. The crosslinking component can be selected in various effective amounts, such as from about 1 to about 5 percent by weight. The extruder temperature is from about 110° C. to about 150° C., and preferably about 130° C.

Specific examples of unsaturated polyimide resins, which are crosslinked, include poly(2-methylpentyl pyromellitimide)-maleatimide, poly(hexyl pyromellitimide)-maleatimide, poly(polyisopropoxy 1,2,4,5-cyclohexanediimide)-maleate, poly(2-methylpentyl 1,2,4,5-cyclohexanediimide)-maleate, poly(dodecyl 1,2,4,5-cyclohexanediimide)maleate, poly(dioxypropylene or JEFFAMINE D-230 TM - pyromellitimide)-maleatimide, poly(JEFFAMINE D-230 TM -pyromellitimide)maleatimide, poly(JEFFAMINE D-400 TM or tetraoxypropylene-pyromellitimide)maleatimide, copoly(JEFFAMINE D-230 TM -pyromellitimide)maleatimide, copoly(JEFFAMINE D-400 TM -pyromellitimide)maleatimide, poly(JEFFAMINE EDR-192 TM -pyromellitimide)maleatimide, poly(JEFFAMINE EDR-148 TM -pyromellitimide)maleatimide, poly(JEFFAMINE D-230 TM - bicyclo[2.2.2]oct-7-ene-2,3,5,6-diimide)maleatimide, (JEFFAMINE D-400 TM -bicyclo[2.2.2]oct-7-ene-2,3,5,6-diimide), poly(-JEFFAMINE TM -1,2,4,5-cyclohexanediimide), mixtures thereof, and the like. The crosslinked polyimide resin is present in the toner in various effective amounts, such as from about 85 percent by weight to about 98 percent by weight of the toner comprised of, for example, resin and pigment.

Specific examples of tetracid or dianhydride monomers that can be utilized to prepare the unsaturated polyimide include pyromellitic dianhydride, pyromellitic tetracarboxylic acid, bicyclo[2.2.2]oct-7-ene-2,3,5,6-tetracarboxylic acid, bicyclo[2.2.2]oct-7-ene-2,3,5,6-tetracarboxylic dianhydride, 1,2,4,5-cyclohexanetetracarboxylic acid, 1,2,4,5-cyclohexanetetracarboxylic dianhydride, 1,4,5,8-naphthalene tetracarboxylic dianhydride, 3,4,9,10-perylenetetracarboxylic dianhydride, 5-(2,5-dioxotetrahydrol)-3-methyl-3-cyclohexene- 1,2-dicarboxylic dianhydride, 2,3,2',3'-benzophenone dianhydride, ethylenediamine tetracarboxylic acid, ethylenediamine tetracarboxylic acid dianhydride, mixtures thereof, and the like selected in an effective amount of, for example, from about 0.40 to about 0.475 mole equivalent of unsaturated polyimide.

Specific examples of diamines, including diamino alkanes or diamino alkylene oxides, that can be utilized to prepare the polyimide include diaminoethane, diaminopropane, 2,3-diaminopropane, diaminobutane, diaminopentane, diamino-2-methylpentane, also known as DYTEK A TM available from DuPont Chemical Company, diaminohexane, diamino-trimethylhexane, diaminoheptane, diaminooctane, diaminononane, diaminodecane, diaminododecane, diamino-terminated ethylene oxide, diamino-terminated diethylene oxide available as JEFFAMINE EDR-148 TM from Texaco Chemicals, diamino-terminated diethylene oxide available as JEFFAMINE EDR-148 TM from Texaco Chemicals, diamino-terminated triethylene oxide available as JEFFAMINE EDR-192 TM from Texaco Chemicals, diamino-terminated polyoxypropylene oxide available as JEFFAMINE D-230 TM, JEFFAMINE 400 TM, JEFFAMINE 700 TM all available from Texaco Chemicals, mixtures thereof, and the like; and which are selected in an amount of, for example, from about 0.45 mole equivalent to about 0.55 mole equivalent of unsaturated polyimide resin.

Specific examples of unsaturated monomers utilized to form the unsaturated polyimide include maleic anhydride, fumaric acid, maleic acid, itaconic acid, 2-methylitaconic acid, diesters of fumarate, maleate, and itaconate wherein the alkyl chain of the diester is from 1 to about 23 carbon atoms, mixtures thereof, and the like. These monomers are employed in various effective amounts of, for example, from about 0.1 mole percent to about 15 mole percent by weight of the unsaturated polyimide.

Specific examples of free radical initiators selected for crosslinking the unsaturated polyimide include azo-type initiators such as 2,2'-azobis(dimethyl-valeronitrile), azobis(isobutyronitrile), azobis(cyclohexane-nitrile), azobis(methyl-butyronitrile), mixtures thereof, and the like; peroxide initiators such as benzoyl peroxide, lauroyl peroxide, methyl ethyl ketone peroxide, isopropyl peroxy-carbonate, 2,5-dimethyl-2,5-bis(2-ethylhexanoyl-peroxy)hexane, di-tert-butyl peroxide, cumene hydroperoxide, dichlorobenzoyl peroxide, potassium persulfate, ammonium persulfate, sodium bisulfite, mixtures of potassium persulfate and sodium bisulfite, and mixtures thereof selected in effective amounts of, for example, from about 0.1 percent to about 10 percent by weight of resin.

Various known colorants present in the toner in an effective amount of, for example, from about 1 to about 25 percent by weight of toner, and preferably in an amount of from about 1 to about 10 weight percent, that can be selected include carbon black, like REGAL 330® magnetites, such as Mobay magnetites MO8029 TM, MO8060 TM; Columbian magnetites; MAPICO BLACKS TM and surface treated magnetites; Pfizer magnetites, CB4799 TM, CB5300 TM, CB5600 TM, MCX6369 TM; Bayer magnetites, BAYFERROX 8600 TM, 8610 TM; Northern Pigments magnetites, NP-604 TM, NP-608 TM; Magnox magnetites TMB-100 TM, or TMB-104 TM; and other equivalent black pigments. As colored pigments there can be selected known cyan, magenta, yellow, red, green, brown, blue or mixtures thereof. Specific examples of pigments include HELIOGEN BLUE L6900 TM, D6840 TM, D7080 TM, D7020 TM, PYLAM OIL BLUE TM and PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK TM, and cyan components may also be used, and they are present in effective amounts of from, for example, about 1 weight percent to about 65 weight percent of the toner.

The toner may also include known charge additives such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, negative charge additives like aluminum complexes, and the like.

The disclosures of each of the aforementioned patents are totally incorporated herein by reference.

Surface additives that can be added to the toner compositions of the present invention include, for example, metal salts, metal salts of fatty acids, colloidal silicas, mixtures thereof and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa.

In another embodiment of the present invention, there are provided subsequent to known micronization and classification toner particles with an average volume diameter of from about 5 to about 20 microns comprised of crosslinked polyimide resin, pigment particles, and optional charge enhancing additives.

The crosslinked polyimide resin is present in a sufficient, but effective amount, for example from about 70 to about 95 weight percent. Thus, when 1 percent by weight of the charge enhancing additive is present, and about 10 percent by weight of pigment or colorant, such as carbon black, is contained therein, about 89 percent by weight of resin is selected. Also, the charge enhancing additive may be coated on the pigment particle.

The toner and developer compositions of the present invention may be selected for use in electrostatographic imaging apparatuses containing therein conventional photoreceptors or photoconductive imaging members. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

Developers are generated by admixing the toner of the present invention with known carriers including coated carriers. Examples of carrier cores include iron, steel, ferrites, and the like. Coatings include polymers, such as fluoropolymers, polymethylmethacrylates, and the like. Specific examples of carriers are illustrated in a number of patents, such as U.S. Pat. Nos. 4,937,166 and 4,935,326, the disclosures of which are totally incorporated herein by reference.

The following examples are being supplied to further define various species of the present invention, it being noted that these Examples are intended to illustrate and not limit the scope of the present invention. Parts and percentages are by weight unless otherwise indicated.

EXAMPLE I

Unsaturated polyimide derived from pyromellitic dianhydride, maleic anhydride and diamino-terminated polyoxypropylene available as JEFFAMINE D-230 TM from Texaco Chemical Company was prepared as follows.

Pyromellitic dianhydride (76 grams), maleic anhydride (1.7 grams) and JEFFAMINE-230 TM (81 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were collected. The reactor temperature was then increased to 200° C. with slow purging of nitrogen for 30 minutes and then increased to 225° C. for another 30 minutes. The bottom drain of the reactor was then opened, and the unsaturated poly(JEFFAMINE D-230 TM or dioxypropylene-maleate-pyromellitimide) was allowed to pour into a container cooled with dry ice, and measured to be 120 grams. The number average molecular weight was then measured to be 6,800 grams per mole by vapor pressure osmometry using toluene as the solvent. The glass transition temperature of the product resin was measured using the DuPont Differential Scanning Calorimeter at 10° C. per minute. For the unsaturated polyimide of this Example, a glass transition temperature of 61° C. was obtained.

EXAMPLE II

Unsaturated polyimide derived from pyromellitic dianhydride, maleic anhydride and diamino-terminated polyoxypropylene available as JEFFAMINE D-400 TM from Texaco Chemical Company was prepared as follows.

Pyromellitic dianhydride (76 grams), maleic anhydride (1.7 grams) and JEFFAMINE-400 TM (141 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were as collected. The reactor was then increased to 200° C. with slow purging of nitrogen for 30 minutes and then at 225° C. for another 30 minutes. The bottom drain of the reactor was then opened, and the unsaturated poly(-JEFFAMINE D-230 TM - maleate-pyromellitimide) was allowed to pour into a container cooled with dry ice to yield 120 grams of the aforementioned resin. The number average molecular weight was then measured to be 5,500 grams per mole by vapor pressure osmometry using toluene as the solvent. The glass transition temperature of the resin was measured using the DuPont Differential Scanning Calorimeter at 10° C. per minute. For the unsaturated polyimide of this Example, a glass transition temperature of 1° C. was obtained.

EXAMPLE III

Unsaturated polyimide derived from pyromellitic dianhydride, maleic anhydride and diamino-terminated polyoxypropylenes available as JEFFAMINE D-400 TM and D-230 TM from Texaco Chemical Company was prepared as follows:

Pyromellitic dianhydride (76 grams), maleic anhydride (1.7 grams), JEFFAMINE D-230 TM (40.5 grams) and JEFFAMINE D-400 TM (70 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were collected. The reactor temperature was then increased to 200° C. with slow purging of nitrogen for 30 minutes and then increased to 225° C. for another 30 minutes. The bottom drain of the reactor was then opened, and the unsaturated poly(JEFFAMINE D-230 TM -maleate-pyromellitimide) product was allowed to pour into a container cooled with dry ice, and measured to be 120 grams. The number average molecular weight of the product was then measured to be 6,500 grams per mole by vapor pressure osmometry using toluene as the solvent. The glass transition temperature of the product resin was measured using the DuPont Differential Scanning Calorimeter at 10° C. per minute. For the unsaturated polyimide of this Example, a glass transition temperature of 33° C. was obtained.

EXAMPLE IV

Unsaturated polyimide derived from pyromellitic dianhydride, maleic anhydride and diamino-terminated polyoxypropylenes available as JEFFAMINE D-

400 TM and D-230 TM from Texaco Chemical Company was prepared as follows:

Pyromellitic dianhydride (76 grams), maleic anhydride (1.7 grams), JEFFAMINE D-230 TM (60 grams) and JEFFAMINE D-400 TM (28 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were collected. The reactor temperature was then increased to 200° C. with slow purging of nitrogen for 30 minutes and then increased to 225° C. for another 30 minutes. The bottom drain of the reactor was then opened, and the unsaturated poly(-JEFFAMINE D-230 TM -maleate-pyromellitimide) product was poured into a container cooled with dry ice yielding 120 grams of product. The number average molecular weight was then measured to be 6,500 grams per mole by vapor pressure osmometry using toluene as the solvent. The glass transition temperature of the resin product was measured using the DuPont Differential Scanning Calorimeter at 10° C. per minute. For the unsaturated polyimide of this Example, a glass transition temperature of 50° C. was obtained.

EXAMPLE V

Unsaturated polyimide derived from pyromellitic dianhydride, maleic anhydride and diamino-terminated polyoxypropylenes available as JEFFAMINE D-400 TM and D-230 TM from Texaco Chemical Company was prepared as follows:

Pyromellitic dianhydride (76 grams), maleic anhydride (1.7 grams), JEFFAMINE D-230 TM (70 grams) and JEFFAMINE D-400 TM (19 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were collected. The reactor temperature was then increased to 200° C. with slow purging of nitrogen for 30 minutes and then increased to 225° C. for another 30 minutes. The bottom drain of the reactor was then opened, and the unsaturated poly(-JEFFAMINE D-230-maleate-pyromellitimide) product was poured into a container cooled with dry ice yielding 120 grams of product. The number average molecular weight was then measured to be 6,300 grams per mole by vapor pressure osmometry using toluene as the solvent. The glass transition temperature of the resin was measured using the DuPont Differential Scanning Calorimeter at 10° C. per minute. For the unsaturated polyimide of this Example, a glass transition temperature of 56° C. was obtained.

EXAMPLE VI

A black toner composition comprised of 94 percent by weight of a crosslinked polyimide resin obtained from the resin of Example I and 6 percent by weight of REGAL 330 ® black pigment was prepared as follows:

The unsaturated polyimide resin of Example I was in the form of a large chunk. The resulting polymer was ground to smaller particles of less than 850 microns in a Model J Fitzmill equipped with an 850 micrometer screen. After grinding, 188 grams (94 percent by weight of toner) of the unsaturated polyimide resin was mixed with 12 grams of REGAL 330 ® pigment (6 percent by weight of toner). The two components were dry blended first on a paint shaker and then on a roll mill. A small CSI TM counter rotating twin screw extruder available from Customs Scientific Instrumentations was then used to melt mix the aforementioned mixture with 2 grams of benzoyl peroxide at a barrel temperature of 140° C. to convert the unsaturated polyimide to the corresponding crosslinked polyimide resin with 1 percent by weight of benzoyl peroxide, screw rotational speed of 50 rpm and at a feed rate of 2 grams per minute. The extruded strands were broken into coarse particles utilizing a coffee bean grinder available from Black and Decker. An 8 inch Strutevant micronizer was used to reduce the particle size further. After grinding, the toner was measured to display an average volume diameter particle size of 9.1 microns with a geometric distribution of 1.38 as measured by the Coulter Counter. The resulting toner was then utilized without further classification. A developer composition was prepared by roll milling the aforementioned toner, 3 parts by weight with 100 parts by weight of a carrier comprised of a steel core with polyvinylidene polymer coating thereover, 0.175 weight percent, and with an average diameter of about 90 microns. The tribo data was obtained using the known blow-off Faraday Cage apparatus, and the toner developer was subjected to 20 percent humidity in a chamber for 48 hours and 80 percent RH in a chamber for 48 hours. The ratio of the corresponding triboelectric charge at 20 percent RH to 80 percent RH, as determined by Equation 1, was calculated to be 1.85. Unfused copies were then produced using a Xerox Corporation 1075 imaging apparatus with the fusing system disabled. The unfused copies were then subsequently fused on a Xerox Corporation 1075 fuser using a process speed of 11.9 inches per second. Fusing evaluation of the toner indicated a minimum fixing temperature of about 125° C., and hot-offset temperature of 170° C. The gloss of the solid area images were subsequently measured with a Gardner Gloss metering unit and found to display a gloss of 15 indicative of "matte" finish.

EXAMPLE VII

A black toner composition comprised of 94 percent by weight of a crosslinked polyimide obtained from the unsaturated polyimide resin of Example V and 6 percent by weight of REGAL 330 ® black pigment was prepared as follows.

The unsaturated polyimide resin of Example V was in the form of a large chunk. The resulting polymer was ground to smaller particles of less than 850 microns in a Model J Fitzmill equipped with an 850 micrometer screen. After grinding, 188 grams (94 percent by weight of toner) of polymer were mixed with 12 grams of REGAL 330 ® pigment (6 percent by weight of toner). The two components were dry blended first on a paint shaker and then on a roll mill. A small CSI TM counter rotating twin screw extruder available from Customs Scientific Instrumentations was then used to melt mix the aforementioned mixture with 2 grams of benzoyl peroxide at a barrel temperature of 140° C., screw rotational speed of 50 rpm and at a feed rate of 2 grams per minute resulting in crosslinking of the unsaturated polyimide. The extruded strands were broken into coarse particles utilizing a coffee bean grinder available from Black and Decker. An 8 inch Sturtevant micronizer was used to reduce the particle size further. After grinding, the toner was measured to display an average volume diameter particle size of 9.4 microns with a geometric distribution of 1.39 as measured by the Coulter Counter. The resulting toner was then utilized without further classification. A developer composition was prepared by roll milling the aforementioned toner, 3 parts by weight with 100 parts by weight of the carrier of Example VI. The tribo data was obtained using the known blow-off Faraday Cage apparatus, and the toner developer was subjected to 20 percent humidity in a chamber for 48 hours, and at 80 percent humidity level in a chamber for 48 hours. The ratio of the corresponding triboelectric charge at 20 percent RH to 80 percent RH, as determined by Equation 1, was calculated to be 1.95. Unfused copies were then produced using a Xerox Corporation 1075 imaging apparatus with the fusing system disabled. The unfused copies were then subsequently fused on a Xerox Corporation 1075 fuser using a process speed of 11.9 inches per second. Fusing evaluation of the toner indicated a minimum fixing temperature of about 120° C., and a hot-offset temperature of 165° C. The gloss of the solid area images were subsequently measured by a Gardner Gloss metering unit and found to display a gloss of 16 indicative of "matte" finish.

EXAMPLE VIII

A black toner composition comprised of 94 percent by weight of a crosslinked polyimide obtained from the unsaturated polyimide resin of Example VI and 6 percent by weight of REGAL 330® black pigment was prepared as follows.

The unsaturated polyimide resin of Example IV was in the form of a large chunk. The resulting polymer was ground to smaller particles of less than 850 microns in a Model J Fitzmill equipped with an 850 micrometer screen. After grinding, 188 grams (94 percent by weight of toner) of polymer were mixed with 12 grams of REGAL 330® pigment (6 percent by weight of toner). The two components were dry blended first on a paint shaker and then on a roll mill. A small CSI TM counter rotating twin screw extruder available from Customs Scientific Instrumentations was then used to melt mix the aforementioned mixture with 2 grams of benzoyl peroxide at a barrel temperature of 140° C., screw rotational speed of 50 rpm and at a feed rate of 2 grams per minute thereby converting the unsaturated polyimide to the corresponding crosslinked polyimide resin. The extruded strands were broken into coarse particles utilizing a coffee bean grinder available from Black and Decker. An 8 inch Sturtevant micronizer was used to reduce the particle size further. After grinding, the toner was measured to display an average volume diameter particle size of 7.4 microns with a geometric distribution of 1.36 as measured by the Coulter Counter. The resulting toner was then utilized without further classification. A developer composition was prepared by roll milling the aforementioned toner, 3 parts by weight with 100 parts by weight of the carrier of Example V. The tribo data was obtained using the known blow-off Faraday Cage apparatus, and the toner developer was subjected to 20 percent humidity in a chamber for 48 hours, and at 80 percent humidity level in a chamber for 48 hours. The ratio of the corresponding triboelectric charge at 20 percent RH to 80 percent RH, as determined by Equation 1, was 1.8. Unfused copies were then produced using a Xerox Corporation 1075 imaging apparatus with the fusing system disabled. The unfused copies were then subsequently fused on a Xerox Corporation 1075 fuser using a process speed of 11.9 inches per second. Fusing evaluation of the toner indicated a minimum fixing temperature of about 115° C., and hot-offset temperature of 160° C. The gloss of the solid area images were subsequently measured with a Gardner Gloss metering unit and found to display a gloss of 18 indicative of "matte" finish.

Other modifications of the present invention may occur to those skilled in the art subsequent to a review of the present application and these modifications, including equivalents thereof, are intended to be included within the scope of the present invention.

What is claimed is:

1. A toner composition comprised of a pigment and a crosslinked polyimide, and wherein said crosslinked polyimide is obtained from the reaction of a peroxide with an unsaturated polyimide of the formula

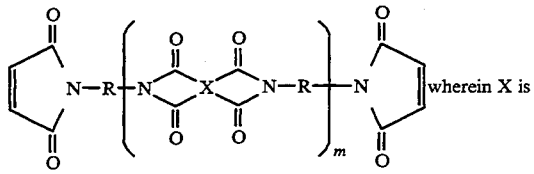

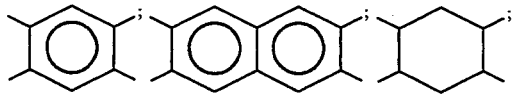

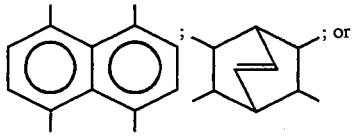

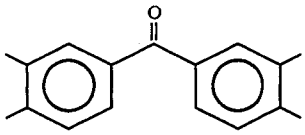

R is alkyl or oxyalkylene; and m represents the number of monomer segments present, and is a number of from about 10 to about 1,000.

2. A toner in accordance with claim 1 wherein the number average molecular weight of said unsaturated polyimide is from about 3,000 to about 10,000 grams per mole as measured by vapor pressure osmometry.

3. A toner in accordance with claim 1 wherein the peroxide is benzoyl peroxide, lauroyl peroxide, methyl ethyl ketone peroxide, isopropyl peroxy-carbonate, 2,5-dimethyl-2,5-bis(2-ethylhexanoylperoxy)hexane, di-tert-butyl peroxide, cumene hydroperoxide, dichlorobenzoyl peroxide selected in an amount of from about 0.5 percent to about 5 percent by weight of unsaturated polyimide.

4. A toner in accordance with claim 1 wherein the crosslinked polyimide has a number average molecular weight of from about 5,000 to about 500,000.

5. A toner in accordance with claim 1 which possesses a low fixing temperature of from about 115° C. to about 145° C. and a broad fusing latitude of from about 40° C. to about 100° C.

6. A toner composition in accordance with claim 1 with a glass transition temperature thereof of from about 50° C. to about 65° C.

7. A toner composition in accordance with claim 1 with a relative humidity sensitivity of from about 1.01 to about 2.5.

8. A toner composition in accordance with claim 1 further including a charge enhancing additive incorporated into the toner, or present on the surface of the toner.

9. A toner in accordance with claim 1 wherein the unsaturated polyimide is derived from the reaction of a dianhydride or organotetracid, an unsaturated diacid or an unsaturated anhydride, and a diamine.

10. A toner in accordance with claim 9 wherein the dianhydride or organotetracid is selected from the group consisting of pyromellitic dianhydride, pyromellitic tetracarboxylic acid, bicyclo[2.2.2]oct-7-ene-2,3,5,6-tetracarboxylic acid, bicyclo[2.2.2]oct-7-ene-2,3,5,6-tetracarboxylic dianhydride, 1,2,4,5-cyclohexanetetracarboxylic acid, 1,2,4,5-cyclohexanetetracarboxylic dianhydride, 1,4,5,8-naphthalenetetracarboxylic dianhydride, 3,4,9,10-perylenetetracarboxylic dianhydride, and 5-(2,5-dioxotetrahydrol)-3-methyl-3-cyclohexene-1,2-dicarboxylic dianhydride, 2,3,2',3'-benzophenone dianhydride, and represents from about 0.4 to about 0.475 mole percent of the unsaturated polyimide.

11. A toner in accordance with claim 9 wherein the unsaturated anhydride is maleic anhydride present in effective amounts of from about 0.1 mole percent to about 15 mole percent by weight of the unsaturated polyimide.

12. A toner in accordance with claim 9 wherein the diamine is selected from the group consisting of diaminoethane, diaminopropane, 2,3-diaminopropane, diaminobutane, diaminopentane, diamino-2-methylpentane (DYTEK A TM) diaminohexane, diaminotrimethylhexane, diaminoheptane, diaminooctane, diaminononane, diaminodecane, diaminododecane, diamino-terminated diethyleneoxide, diamino-terminated triethyleneoxide, and a polyoxyalkylene of the formula

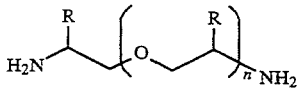

wherein R represents a hydrogen or alkyl group; and n represents the number of monomer segments, and is a number of from about 1 to about 10.

13. A toner composition in accordance with claim 1 further containing as external additives metal salts of a fatty acid, colloidal silicas, or mixtures thereof.

14. A toner composition in accordance with claim 1 wherein the pigment is carbon black, magnetites, or mixtures thereof, cyan, magenta, yellow, red, blue, green, brown, or mixtures thereof.

15. A developer composition comprised of a pigment and a crosslinked polyimide, and wherein said crosslinked polyimide is obtained from the reaction of a peroxide with an unsaturated polyimide of the formula

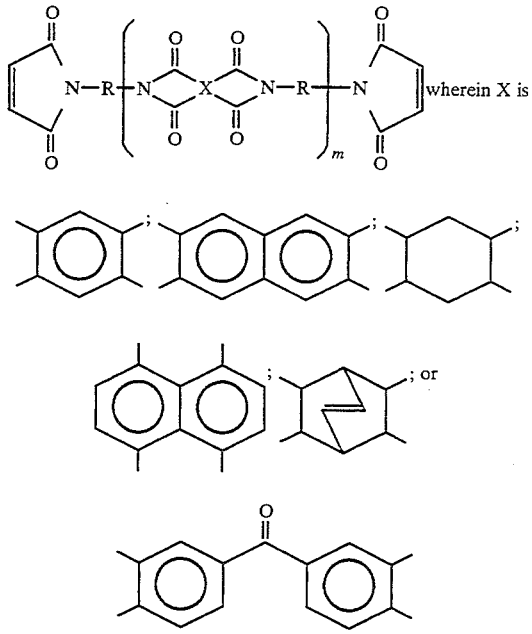

R is alkyl or oxyalkylene; and m represents the number of monomer segments present, and is a number of from about 10 to about about 1,000;. and carrier particles.

16. A developer composition in accordance with claim 15 wherein the carrier particles are comprised of ferrites, steel, or an iron powder with an optional coating, or mixture of coatings.

17. A method of imaging which comprises formulating an electrostatic latent image on a negatively charged photoreceptor, affecting development thereof with the toner composition of claim 1, and thereafter transferring the developed image to a suitable substrate.

18. A method in accordance with claim 17 wherein the gloss of the image is from about 1 to about 30 gloss units.

19. A method in accordance with claim 17 wherein the developed image is in a matte form.

20. A toner in accordance with claim 1 wherein said polyimide is selected from the group consisting of poly(2-methylpentyl pyromellitimide)-maleatimide, poly(-hexyl pyromellitimide)-maleatimide, poly(polyisopropoxy 1,2,4,5-cyclohexanediimide)-maleate, poly(2-methylpentyl 1,2,4,5-cyclohexanediimide)-maleate, poly(dodecyl 1,2,4,5-cyclohexanediimide)-maleate, poly(dioxypropylene-pyromellitimide)maleatimide, poly(dioxypropylene-pyromellitimide)maleatimide, poly(tetraoxypropylene-pyromellitimide)maleatimide, copoly(dioxypropylene-pyromellitimide)maleatimide, copoly(tetraoxypropylene-pyromellitimide)maleatimide, poly(JEFFAMINE EDR-192 TM - pyromellitimide)maleatimide, poly(JEFFAMINE EDR-148 TM -pyromellitimide)maleatimide, poly(dioxypropylene-bicyclo[2.2.2]oct-7-ene-2,3,5,6-diimide)maleatimide, (tetraoxypropylene-bicyclo[2.2.2]oct-7-ene-2,3,5,6-diimide), poly(JEFFAMINE TM -1,2,4,5-cyclohexanediimide), and mixtures thereof.

21. The toner in accordance with claim 9 wherein said polyimide is selected from the group consisting of poly(2-methylpentyl pyromellitimide)-maleatimide, poly(hexyl pyromellitimide)-maleatimide, poly(polyisopropoxy 1,2,4,5-cyclohexanediimide)-maleate, poly(2-methylpentyl 1,2,4,5-cyclohexanediimide)-maleate, poly(dodecyl 1,2,4,5-cyclohexanediimide)-maleate, poly(dioxypropylene-pyromellitimide)maleatimide, poly(dioxypropylene-pyromellitimide)maleatimide, poly(tetraoxypropylene-pyromellitimide)maleatimide, copoly(dioxypropylene-pyromellitimide)maleatimide, copoly(tetraoxypropylene-pyromellitimide)maleatimide, poly(JEFFAMINE EDR-192 TM -pyromellitimide)maleatimide, poly(JEFFAMINE EDR-148 TM -pyromellitimide)maleatimide, poly(dioxypropylene-bicyclo[2.2.2]oct-7-ene-2,3,5,6-diimide)maleatimide, (tetraoxypropylene-bicyclo[2.2.2]oct-7-ene-2,3,5,6-diimide), and poly(JEFFAMINE TM -1,2,4,5-cyclohexanediimide).

22. A toner composition consisting essentially of a pigment and a crosslinked polyimide, and wherein said crosslinked polyimide is obtained from the reaction of a peroxide with an unsaturated polyimide of the formula

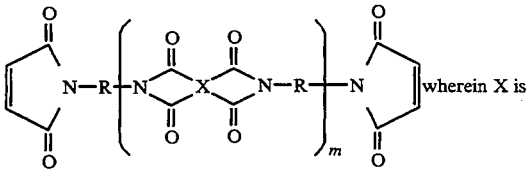

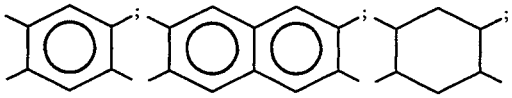

-continued

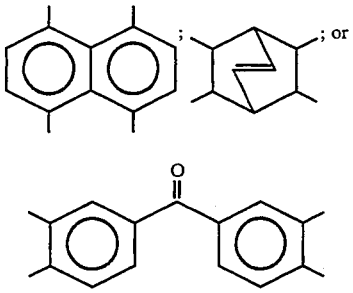

R is alkyl or oxyalkylene; and m represents the number of monomer segments present, and is a number of from about 10 to about 1,000.

23. A toner in accordance with claim 22 wherein said polyimide is selected from a group consisting of poly(2-methylpentyl pyromellitimide)-maleatimide, poly(hexyl pyromellitimide)-maleatimide, poly(polyisopropoxy 1,2,4,5-cyclohexanediimide)-maleate, poly(2-methylpentyl 1,2,4,5-cyclohexanediimide)-maleate, poly(dodecyl 1,2,4,5-cyclohexanediimide)-maleate, poly(dioxypropylene-pyromellitimide)maleatimide, poly(dioxypropylene-pyromellitimide)maleatimide, poly(tetraoxypropylene-pyromellitimide)maleatimide, copoly(dioxypropylene-pyromellitimide)maleatimide, copoly(tetraoxypropylene-pyromellitimide)maleatimide, poly(dioxypropylene-bicyclo[2.2.2]oct-7-ene-2,3,5,6-diimide)-maleatimide, and (tetraoxypropylene-bicyclo[2.2.2]oct-7-ene-2,3,5,6-diimide).

* * * * *